US005192467A

United States Patent [19]

Strunc et al.

[11] Patent Number: 5,192,467

[45] Date of Patent: Mar. 9, 1993

[54] AERATION PANEL STRUCTURE

[75] Inventors: Robert W. Strunc, Coral Springs; Oscar L. Bango, Miami, both of Fla.

[73] Assignee: Parkson Corporation, Fort Lauderdale, Fla.

[21] Appl. No.: 908,307

[22] Filed: Jul. 2, 1992

[51] Int. Cl.[5] ..... B01F 3/04

[52] U.S. Cl. ..... 261/122.1; 160/402

[58] Field of Search ..... 261/122.1, 122.2; 160/402, 403

[56] References Cited

U.S. PATENT DOCUMENTS

| | | | |
|---|---|---|---|
| 299,359 | 5/1884 | Doty . | |
| 1,250,376 | 12/1917 | Starbuck et al. . | |
| 1,343,123 | 6/1920 | Gahl et al. | 261/122.2 |
| 1,642,051 | 9/1927 | Wall | 261/122.1 |
| 1,792,286 | 2/1931 | Curry et al. | 261/122.1 |
| 1,873,843 | 8/1932 | MacDonald | 261/122.1 |
| 1,987,860 | 1/1935 | Milone | 160/403 |
| 2,040,941 | 5/1936 | Jones et al. | 210/220 |
| 2,687,287 | 8/1954 | Coppock | 261/124 |
| 2,978,234 | 4/1961 | Lamb | 261/122.1 |
| 3,058,518 | 10/1962 | Housman | 160/380 |
| 3,111,686 | 11/1963 | Sierant . | |
| 3,182,978 | 5/1965 | Reilly | 210/220 |
| 3,330,330 | 7/1967 | Sanderson | 160/402 |
| 3,490,752 | 1/1970 | Danjes et al. | 261/122.1 |
| 3,529,653 | 9/1970 | Fey, Jr. | 160/374.1 |
| 4,007,240 | 2/1977 | Gosden | 261/122.1 |
| 4,234,035 | 11/1980 | Babbs | 160/392 |
| 4,382,867 | 5/1983 | Schmit et al. | 261/122.1 |
| 4,410,027 | 10/1983 | Lucous | 160/380 |
| 4,422,983 | 12/1983 | Bardo et al. | 261/24 |
| 4,569,805 | 2/1986 | Hume et al. | 261/122.1 |
| 4,624,781 | 11/1986 | Messner | 261/122.1 |
| 4,629,126 | 12/1986 | Goudy, Jr. et al. | 261/122.2 |
| 4,631,134 | 12/1986 | Schüssler | 261/122.2 |
| 4,639,314 | 1/1987 | Tyer | 261/122.1 |
| 4,658,522 | 4/1987 | Kramer | 38/102.91 |
| 4,842,779 | 6/1989 | Jäger | 261/122.1 |
| 5,015,421 | 5/1991 | Messner | 261/122.1 |

FOREIGN PATENT DOCUMENTS

| | | | |
|---|---|---|---|
| 0229386 | 7/1987 | European Pat. Off. . | |
| 2942607 | 4/1981 | Fed. Rep. of Germany . | |
| 3600232 | 7/1987 | Fed. Rep. of Germany | 261/122.2 |
| 396732 | 8/1933 | United Kingdom . | |

*Primary Examiner*—Tim Miles

*Attorney, Agent, or Firm*—Brumbaugh, Graves, Donohue & Raymond

[57] ABSTRACT

In the aeration panel structure described in the specification, a porous membrane is mounted on a flat plate with peripheral hold-down strips secured at spaced points to the plate and a foam tape having adhesive on both surfaces is interposed between the plate and the membrane and between the membrane and the peripheral hold-down strips to retain the membrane in place and assure a good seal with the support plate. In addition, middle hold-down strips are provided to prevent billowing of the membrane and, at each end, the middle hold-down strips extend above the peripheral hold-down strips to assure air distribution beneath the membrane. Adjustable anchor bolts are provided to mount the aeration panel structure to the bottom of a liquid container.

7 Claims, 1 Drawing Sheet

AERATION PANEL STRUCTURE

BACKGROUND OF THE INVENTION

This invention relates to aeration panels for injecting fine bubbles of air into liquid contained in a tank or basin to diffuse oxygen into the liquid.

The patent to Messner, U.S. Pat. No. 4,624,781, discloses a panel-type air diffusion device for injecting small air bubbles into a body of water. That device has a flexible membrane which is clamped to a support plate around its periphery and includes hold-down strips clamping the membrane to the support plate in the central region to prevent billowing of the membrane. In addition, ballast weights may be included to prevent the diffusion device from floating upwardly in the body of water. In this Messner patent, the membrane is clamped directly between the support plate and the peripheral hold-down strips, and the ends of the middle hold-down strips are spaced from the peripheral hold-down strips to permit passage of air from a central inlet beneath the membrane to the outer portions of the diffuser.

As noted in the later Messner U.S. Pat. No. 5,015,421, the connection between the peripheral clamping strips and the membrane of the diffuser in U.S. Pat. No. 4,624,781 tends to weaken in the regions of the screw or rivet attachment points holding the edge strips and, to overcome that problem, U.S. Pat. No. 5,015,421 discloses a membrane which is clamped to a support panel around its periphery with special continuous clamping arrangements rather than point attachments such as screws or rivets. That patent also discloses middle hold-down strips which extend only along a portion of the panel, leaving unrestrained parts of the membrane near the ends of the panel.

German Offenlegungsschrift No. 29 42 607 of Messner describes an aeration panel having a perforated foil and an unperforated foil which are supported and clamped around their periphery by bolts with a layer of adhesive interposed between the two foil layers at the periphery. European Patent Publication No. 0 229 386 describes a disk-shaped aerator having a rubber membrane bonded to a support disk around its periphery. None of these prior art arrangements, however, have been completely satisfactory from the standpoint of retaining the peripheral edge of a membrane in a submerged aerator in secure sealing relation with a support plate and restraining central regions of the membrane from billowing upwardly while permitting air to pass from a central inlet to all regions of the aerator.

SUMMARY OF THE INVENTION

Accordingly, it is an object of the present invention to provide an aeration panel structure which overcomes the above-mentioned disadvantages of the prior art.

Another object of the invention is to provide an aeration panel structure which is simple and convenient to manufacture and install and which provides secure sealing between an aeration membrane and its support panel around the periphery of the membrane.

These and other objects of the invention are attained by providing an aeration panel structure which includes a support panel, a porous membrane mounted adjacent to the support panel, peripheral hold-down strips to retain the periphery of the membrane to the periphery of the panel, and a strip of foam material having adhesive on both surfaces interposed between the membrane and the support panel beneath the peripheral hold-down strips. If desired, an additional strip of foam material having adhesive on both surfaces may also be interposed between the periphery of the membrane and the peripheral hold-down strip. In this way, the porous membrane is securely sealed to the support plate around its periphery without providing high-stress points localized at rivets or attachment screws which can weaken the membrane in those regions. In addition, the membrane is securely affixed to the support plate around its entire periphery even though the attachment members, such as rivets or screws, may have a substantial spacing. The aeration panel of the invention also includes an array of central hold-down strips affixed through the membrane to the support plate along the central region and spaced from the membrane at their ends by engagement with the peripheral hold-down strips to prevent billowing of the membrane while permitting passage of air from a central inlet to all regions of the aerator.

To prevent flotation of the aeration panel without requiring a massive structure or ballast, the panel may be secured by anchor bolts to the bottom of an aeration tank or basin with appropriate spacers and leveling arrangements.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENT

Figures 1, 2:
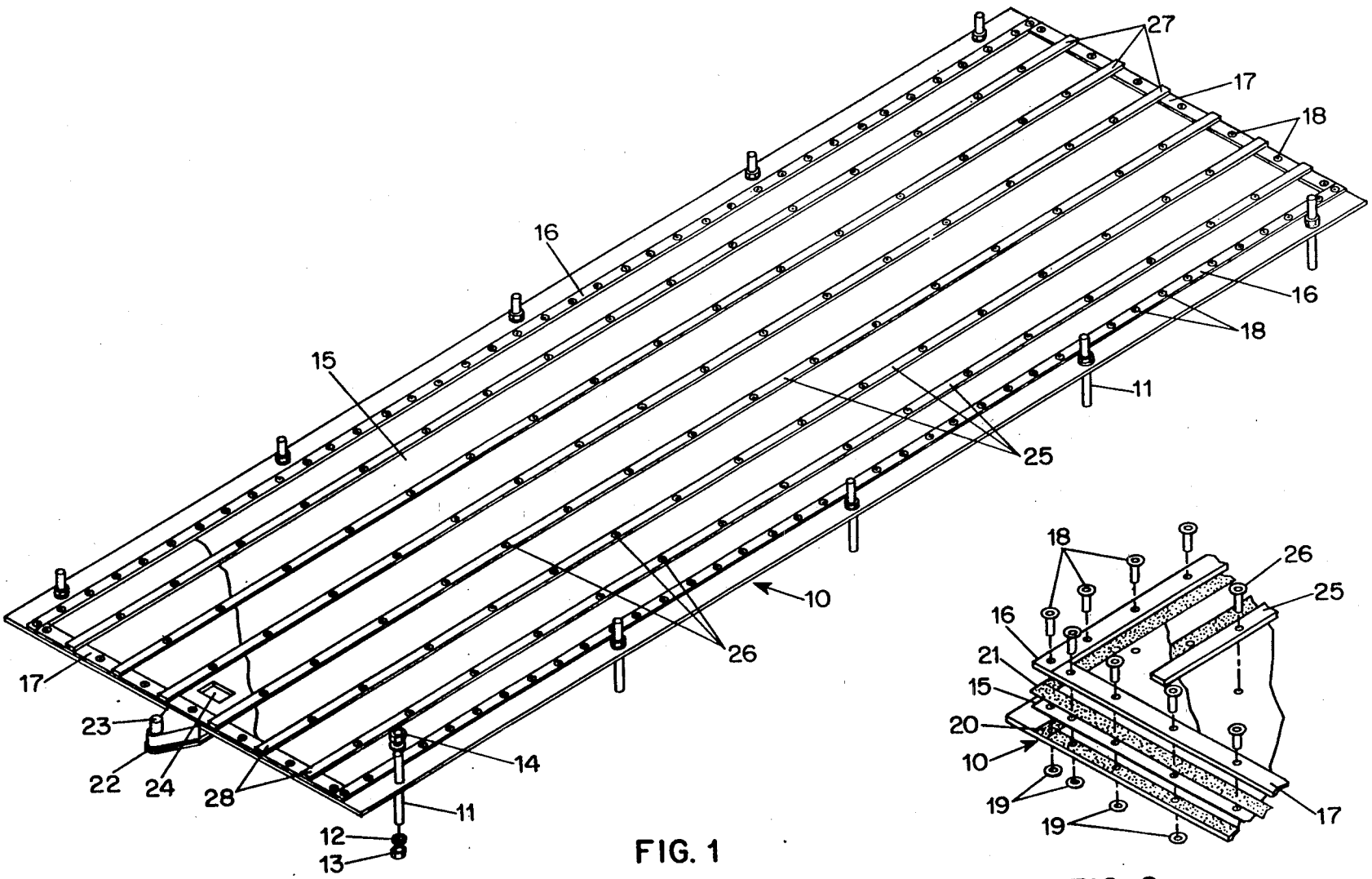
FIG. 1 is a perspective view showing a representative embodiment of an aeration panel structure arranged in accordance with the invention.
FIG. 2 is an enlarged, exploded fragmentary view illustrating the structure of the embodiment of FIG. 1 in greater detail.

In the typical embodiment of the invention shown in the drawings, an aerator panel structure according to the invention includes a flat panel member 10, which may, for example, be a plate of plastic material such as polyvinyl chloride which is four feet wide and eight to twelve feet long, has a series of holes along each edge through which anchor bolts 11 are inserted to anchor the panel structure to the bottom of a tank or basin (not shown) in which the aerator is to be mounted. Each anchor bolt includes a spacer 12 for determining the spacing of the panel from the bottom of the tank and adjusting nuts 13 and 14 to permit leveling of the panel when it is mounted in the basin.

A porous membrane 15, through which fine bubbles of air can be ejected under pressure, is slightly narrower than the panel 10, but has the same length as the panel. The membrane 15 is mounted in sealing relation to the panel 10 around its periphery by a pair of side hold-down strips 16 at opposite sides of the panel and a pair of end hold-down strips 17 at opposite ends of the panel These strips are secured to the panel by a series of pop rivets 18 at spacings of, for example, six inches. As best seen in FIG. 2, the pop rivets 18 have corresponding washers 19 at the bottom of the panel so that uniform pressure is applied between the peripheral hold-down strip and the panel in the region of each rivet. In order to assure a continuous seal between the membrane 15 and the plate 10 and to assist in holding the membrane in position against the plate around its periphery without stressing the membrane at the locations of the rivets 18, a strip of acrylic foam tape 20, coated with adhesive on both sides, is positioned between the membrane and the support plate beneath the peripheral hold-down strips 16 and 17. In addition, another strip 21 of acrylic foam tape coated on both sides with adhesive is inserted between the membrane 15 and the peripheral hold-down strips 16 and 17. This strip also serves as an aid in holding the membrane in place in the aeration structure. Because the adhesive-coated tapes 20 and 21 are made of a foam material, they have a resilient characteristic which assists in maintaining the seal and holding the membrane in place in the spaces between the rivets.

At one end, the aeration panel structure includes an air inlet vent 22 which conducts air under pressure from an intake opening 23 outside the membrane to an internal opening 24 in the panel through which the air under pressure is introduced between the panel 10 and the membrane 15. In order to prevent the membrane 15 from billowing upwardly when air is introduced between the panel and the membrane, which could exert excessive strain on the seal between the membrane and the panel and could also cause uneven distribution of the air bubbles generated by the membrane, the aeration panel structure includes a series of middle hold-down strips 25 extending lengthwise at spaced intervals between the side edges of the membrane. The strips 25 are attached by pop rivets 26 to the panel 10 so a to hold the membrane against the panel in the regions beneath the strips but, in this case, n adhesive-coated foam tape is included since there is no unilateral stress on the membrane and any leakage of air between the membrane and the plate in the regions beneath the strips would not cause any difficulty. Moreover, in order to assure proper distribution of air received beneath the membrane 15 through the opening 24 across the width of the aeration panel structure, the ends 27 and 28 of the middle hold-down strips 25 extend above the end hold-down strips 17, providing a gap equal to the thickness of the end hold-down strips to permit air to pass from the inlet 24 to all of the regions between the plate I and the membrane 15.

Thus, with the aeration panel structure according to the invention, a large aeration panel is provided which has a thin, light-weight structure so as to permit the panels to be stacked in groups for easy transportation, while providing a secure, permanent seal between the periphery of the membrane and the underlying plate and assuring uniform distribution of air throughout the area of the membrane without permitting billowing of the membrane.

Although the invention has been described herein with reference to a specific embodiment, many modifications and variations therein will readily occur to those skilled in the art. Accordingly, all such variations and modifications are included within the intended scope of the invention.

We claim:

1. An aeration panel structure comprising a support plate, a porous membrane mounted adjacent to the support plate arranged to produce fine air bubbles when subjected to air pressure beneath a liquid, air inlet means for introducing air between the panel and the membrane, peripheral hold-down strip means for clamping the membrane to the plate and secured by attachment means at spaced positions to the plate, and foam tape means made of a foamed material and having adhesive on both surfaces interposed between the membrane and the plate beneath the peripheral hold-down strip means to seal the membrane to the plate and hold the membrane in place in the spaces between the attachment means.

2. An aeration panel structure according to claim 1 including further foam tape means having adhesive on both surfaces disposed between the membrane and the peripheral hold-down strip means.

3. An aeration panel structure according to claim 1 wherein the attachment means comprise pop rivets with washers at the deformed ends of the rivets.

4. An aeration panel structure according to claim 1 including a plurality of middle hold-down strip means disposed above the membrane and attached at spaced intervals to the plate and having end portions which extend above the peripheral hold-down strip means.

5. An aeration panel structure according to claim 1 including anchor bolt means disposed at spaced intervals along edges of the panel and arranged to be affixed to the bottom of a liquid container in which the aeration panel structure is mounted.

6. An aeration panel structure according to claim 5 including spacer means associated with the anchor bolt means for spacing the panel from the bottom of the liquid container.

7. An aeration panel structure according to claim 5 including adjustment nut means on the anchor bolt means for leveling the aeration panel structure.

* * * * *